US006454905B1

(12) United States Patent
Hollmark et al.

(10) Patent No.: US 6,454,905 B1
(45) Date of Patent: Sep. 24, 2002

(54) METHOD OF PRODUCING A PAPER HAVING A THREE-DIMENSIONAL PATTERN

(75) Inventors: Holger Hollmark, Stockholm; Lennart Reiner, Karlstad; Thomas Billgren, Kullavik; Kaveh Tondkar; Bengt Järrehult, both of Göteborg; Mats Söderberg, Sundsvall, all of (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 09/822,283

(22) Filed: Apr. 2, 2001

Related U.S. Application Data

(63) Continuation of application No. PCT/SE99/01723, filed on Sep. 29, 1999.

(30) Foreign Application Priority Data

Oct. 1, 1998 (SE) ..... 9803361

(51) Int. Cl.[7] ..... D21F 3/08; D21F 5/00

(52) U.S. Cl. ..... 162/206; 162/117; 162/205; 162/207

(58) Field of Search ..... 162/107, 109, 162/113, 117, 118, 205, 206, 207

(56) References Cited

U.S. PATENT DOCUMENTS

| | | | | | |
|---|---|---|---|---|---|
| 4,324,613 | A | * | 4/1982 | Wahren | 162/111 |
| 4,976,820 | A | * | 12/1990 | Laapotti | 162/206 |
| 5,520,778 | A | * | 5/1996 | Sawdai | 162/115 |
| 5,810,974 | A | * | 9/1998 | Laapotti | 162/358.5 |
| 6,344,110 | B1 | * | 2/2002 | Reiner et al. | 162/109 |

FOREIGN PATENT DOCUMENTS

| | | |
|---|---|---|
| EP | 0 490 655 | 6/1992 |

* cited by examiner

*Primary Examiner*—Dean T. Nguyen
(74) *Attorney, Agent, or Firm*—Young & Thompson

(57) ABSTRACT

Method of producing an impulse dried paper having a three-dimensional pattern of alternating raised and recessed portions, which have been provided in connection with impulse drying, at which the wet paper web (10) is passed through at least two press nips (12*a,b*), each comprising a rotatable heated roll (13*a,b*) which is heated and that the paper web during the passage through the press nips is given a three-dimensional pattern of alternating raised and recessed portions either by means of a patterned wire (11'), -band or belt and/or by a pattern on the heated roll (13*a,b*).

18 Claims, 3 Drawing Sheets

METHOD OF PRODUCING A PAPER HAVING A THREE-DIMENSIONAL PATTERN

This is a continuation of co-pending international application No. PCT/SE99/01723 filed on Sep. 29, 1999, which designated the United States of America.

TECHNICAL FIELD

The present invention refers to a method of producing a paper having a three dimensional pattern of alternating raised and recessed portions, which has been provided in connection with impulse drying, at which the wet paper web is passed through at least one press nip comprising a rotatable roll which is heated and that the paper web during the passage through the press nip is given a three dimensional pattern of alternating raised and recessed portions either by means of a patterned wire, band or belt and/or by a pattern on the heated roll and where said pattern is pressed into the paper web against a counter means.

BACKGROUND OF THE INVENTION

Moist paper webs are usually dried against one or more heated rolls. A method which is commonly used for tissue paper is so called Yankee drying. At Yankee drying the moist paper web is pressed against a steam-heated Yankee cylinder, which can have a very large diameter. Further heat for drying is supplied by blowing of heated air. If the paper to be produced is soft paper the paper web is usually creped against the Yankee cylinder. The drying against the Yankee cylinder is preceded by a vacuum dewatering and a wet pressing, in which the water is mechanically pressed out of the paper web.

Another drying method is so called through-air-drying (TAD). In this method the paper is dried by means of hot air which is blown through the moist paper web, often without a preceding wet pressing. The paper web which enters the throug-hair-dryer is then only vacuum dewatered and has a dry content of about 25–30% and is dried in the through-air-dryer to a dry content of about 65–95%. The paper web is transferred to a special drying fabric and is passed over a so called TAD cylinder having an open structure. Hot air is blown through the paper web during its passage over the TAD cylinder. Paper produced in this way, mainly soft paper, becomes very soft and bulky. The method however is very energy-consuming since all water that is removed has to be evaporated. In connection with the TAD drying the pattern structure of the drying fabric is transferred to the paper web. This structure is essentially maintained also in wet condition of the paper, since it has been imparted to the wet paper web. A description of the TAD technique can be found in e.g. U.S. Pat. No. 3,301,746.

Impulse drying of a paper web is disclosed in e.g. SE-B-423 118 and shortly involves that the moist paper web is passed through the press nip between a press roll and a heated roll, which is heated to such a high temperature that a quick and strong steam generation occurs in the interface between the moist paper web and the heated roll. The heating of the roll is e.g. accomplished by gas burners or other heating devices, e.g. by means of electromagnetic induction. By the fact that the heat transfer to the paper mainly occurs in a press nip an extraordinarily high heat transfer speed is obtained. All water that is removed from the paper web during the impulse drying is not evaporated, but the steam on its way through the paper web carries along water from the pores between the fibers in the paper web. The drying efficiency becomes by this very high.

In EP-A-0 490 655 there is disclosed the production of a paper web, especially soft paper, where the paper simultaneously with impulse drying is given an embossed surface. This embossment is made by pressing a pattern into the paper from one or both sides against a hard holder-on. This gives a compression of the paper and by this a higher density in certain portions just opposite the impressions and a lower density in the intermediate portions.

In DE-A-26 15 889 there is disclosed a thermobonded embossed soft paper. Thermoplastic fibers are added to the paper web and after drying thereof the paper web is heated to a temperature exceeding the softening temperature of the thermoplastic fibers. Simultaneously with this heating the paper is pattern embossed. Through-air-drying is mentioned as a drying method.

THE OBJECT AND MOST IMPORTANT FEATURES OF THE INVENTION

The object of the present invention is to provide a method of producing an impulse dried paper having a three-dimensional pattern, e.g. a soft paper intended as toilet paper, kitchen rolls, paper handkerchiefs, table napkins and the like, and where the paper has a high bulk, high elasticity and a high softness. It is a further object that the method should give a great possibility of choosing the composition and complexity of the pattern. The paper structure should essentially be maintained also in wet condition. This has according to the invention been provided by the fact that the wet paper web is passed through at least one further press nip comprising a rotatable heated roll and that the paper web also during the passage through said further press nip in connection with impulse drying is given a three dimensional pattern of alternating raised and recessed portions.

It is by this possible to provide a combination of patterning effects which cannot be provided in one single press nip, said patterns can on one hand give the paper an attractive structure and on the other hand provide advantageous functional qualities such as strength, draping qualities and absorption capacity.

Further features and advantages of the invention are disclosed in the following description and in the dependant claims.

DESCRIPTION OF THE DRAWINGS

The invention will in the following be closer described with reference to some embodiments shown in the accompanying drawings.

DESCRIPTION OF THE INVENTION

Figure 1:
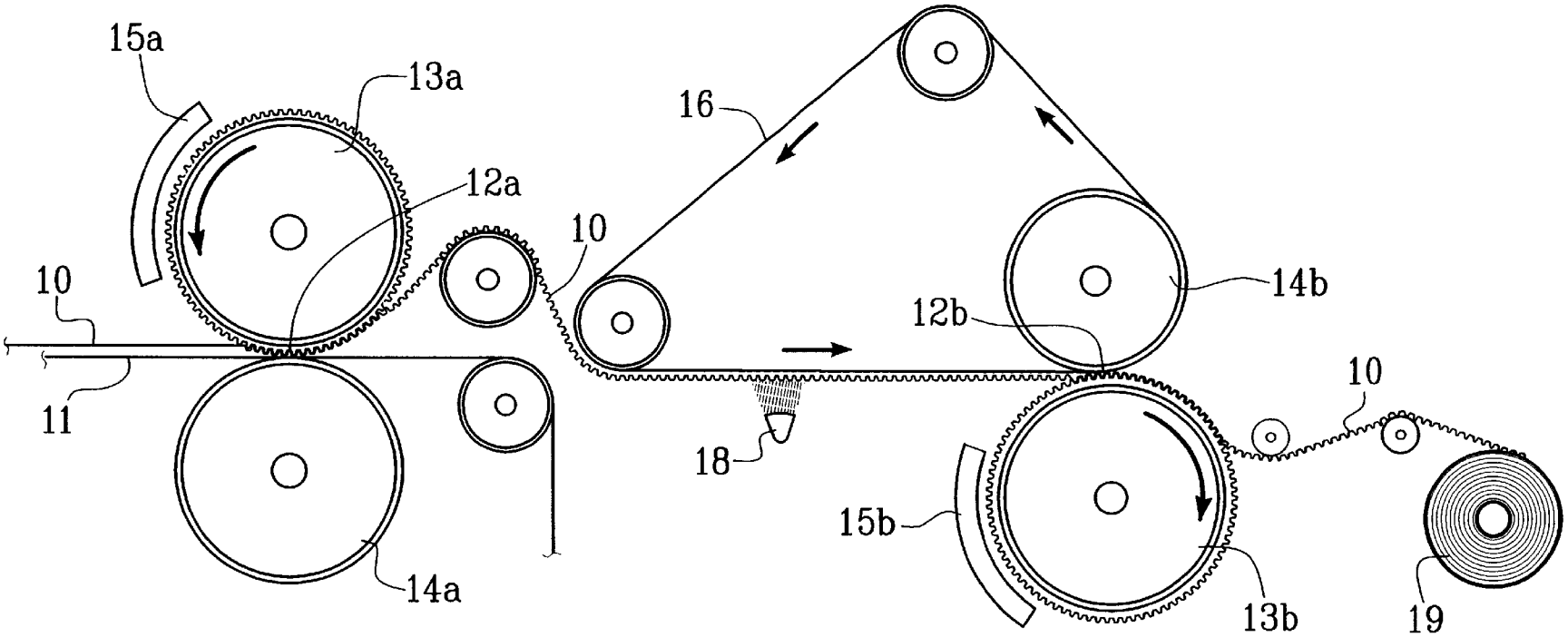
FIGS. 1–3 are schematic side views of an impulse drying device according to some different embodiments.
Figure 2:
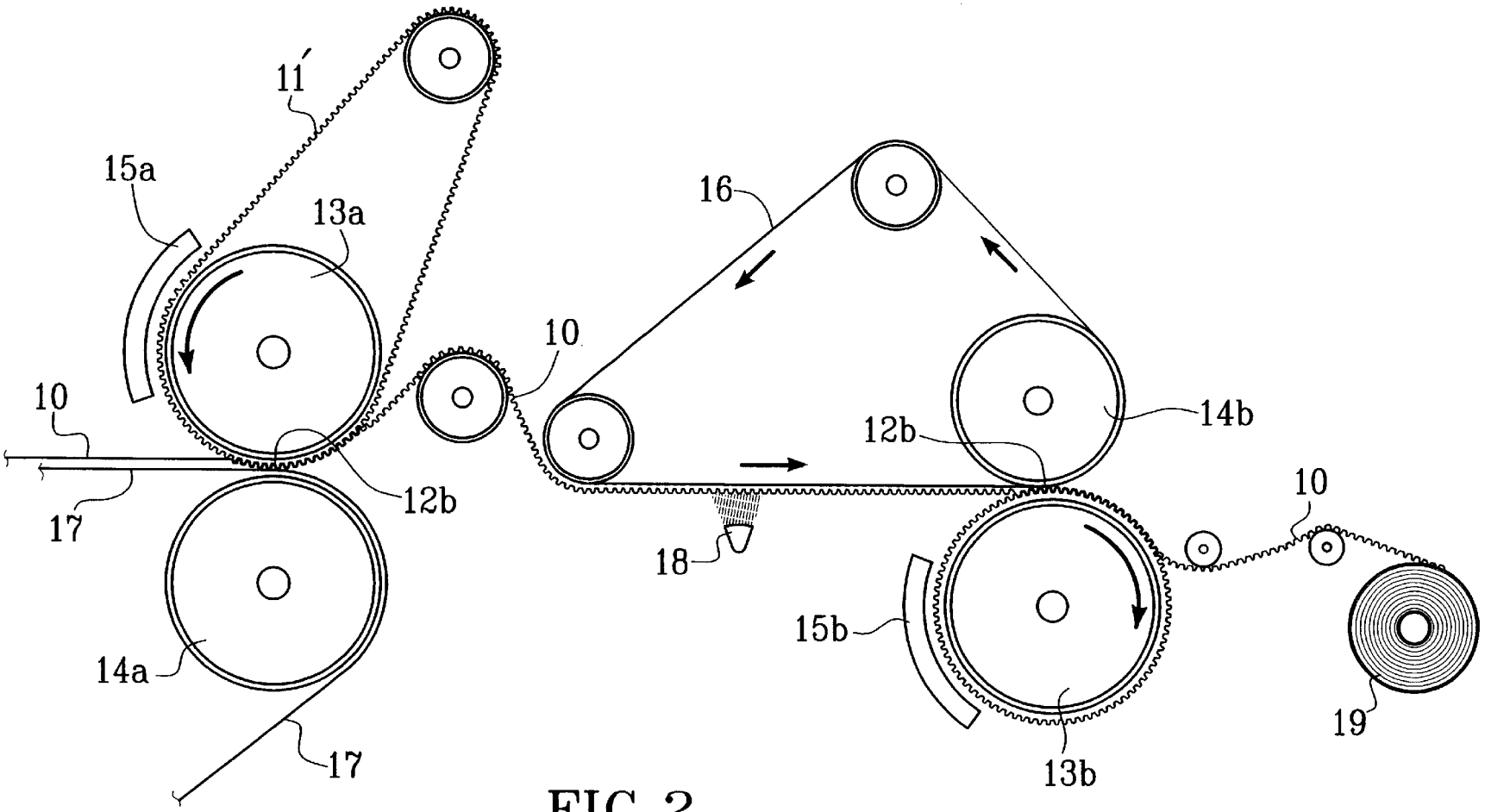
Figure 3:
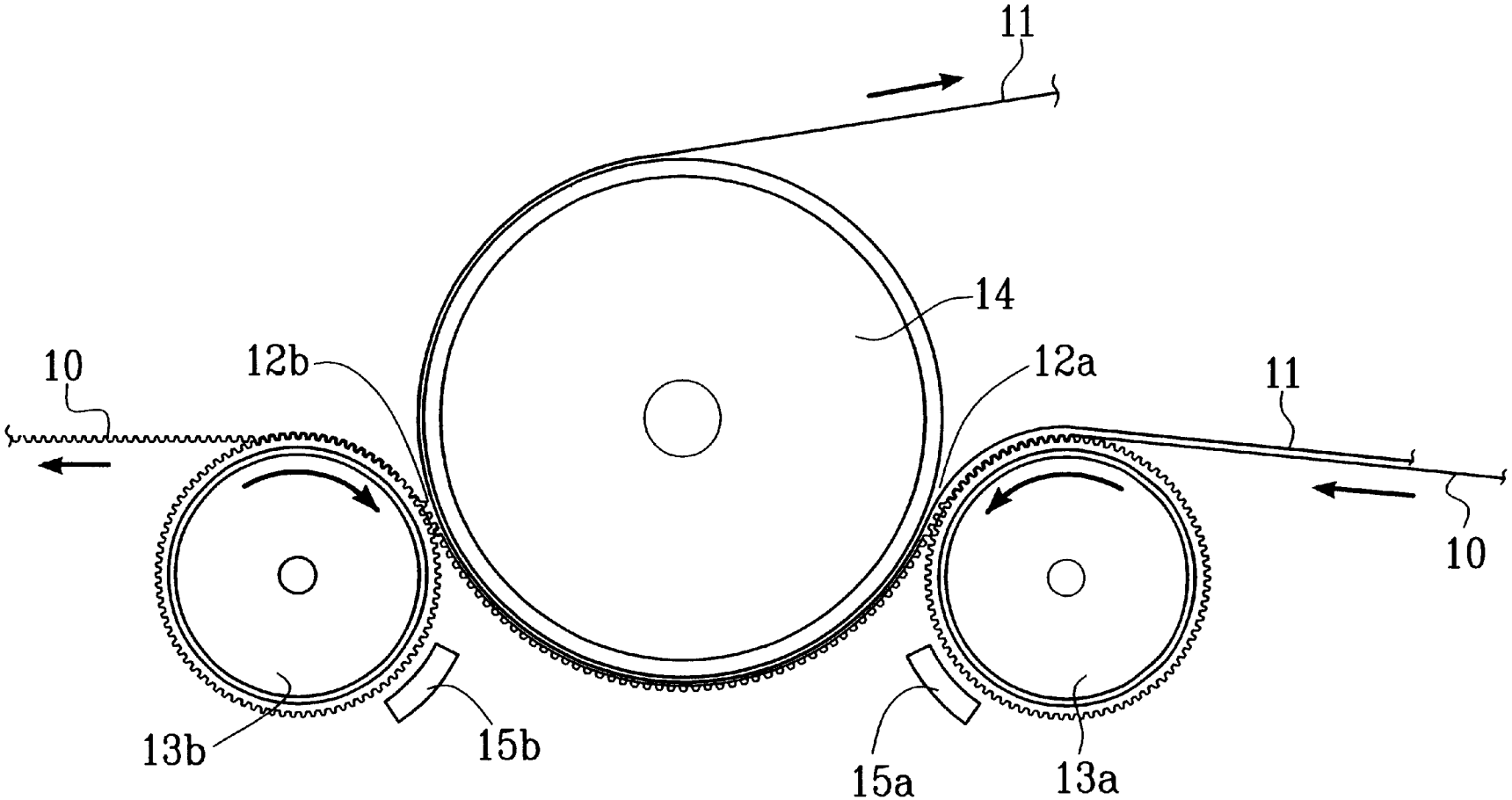

FIGS. 1–3 are schematic side views of an impulse drying device according to some different embodiments.

FIG. 1 shows schematically a device for performing impulse drying of a paper web. The wet paper web 10 which is dewatered over suction boxes (not shown) is supported by a wire or felt 11 and is brought into a press nip 12*a* between two rotatable rolls 13*a* and 14*a,* at which the roll 13*a* which is in contact with the paper web is by a heating device 15*a* heated to a temperature which is sufficiently high for providing drying of the paper web. The surface temperature of the heated roll can very depending on such factors as the moisture content of the paper web, thickness of the paper web, the contact time between the paper web and the roll and the desired moisture content of the completed paper web.

The surface temperature should of course not be so high the paper web is damaged. An appropriate temperature should be in the interval 100–400° C., preferably 150–350° C. and most preferably 200–350° C.

The paper web is pressed against the heated roll 13*a* by means of the roll 14*a*. The press device may of course be designed in many other ways. Two and more press devices may also be arranged after each other. The holder-on 14*a* may also be a press shoe. In the case the paper web 10 is supported by a wire 11 there could be arranged a felt under the wire, said felt extending around the holder-on roll 14*a*. The function of the felt is to improve the dewatering effect and extend the press nip. It is also possible that the paper web 11 is passed into the press nip unsupported, i.e. not supported by any wire or felt.

A very rapid, violent and almost explosive steam generation takes place in the interface between the heated roll 13*a* and the moist paper web, at which the generated steam on its way through the paper web carries away water. For a further description of the impulse drying technique reference is made to the above mentioned SE-B-423 118 and e.g. to EP-A-0 337 973 and U.S. Pat. No. 5,556,511.

The paper web is then transferred to a new wire or felt 16 and into a second press nip 12*b* between two rotatable rolls 13*b* and 14*b*, at which the roll 13*b* which is in contact with the paper web 10 is by means of a heating device 15*b* heated to a temperature which is sufficiently high to provide a second impulse drying of the paper web. This of course implies that the paper web before the second press nip is not completely dry but has a dry content of at least 10 and preferably at least 20 weight-%. This can be achieved if the drying in the first impulse drying step in the press nip 12*a* is not complete and/or that a moistening of the paper web 10 takes place before the second impulse drying step in the press nip 12*b* by means of a moistening device 18.

According to the embodiment shown the patterns are pressed into the paper web from different directions. it is of course also possible to press the different patterns into the paper web from the same direction.

The paper is after drying wound on a wind-up roll 19. If desired the paper can be creped before winding. It is however noted that the need for creping the paper in order to impart softness and bulk which is aimed at for soft paper, is reduced when using the impulse drying method according to the invention, since the paper by the three-dimensional structure and the chosen pattern is imparted bulk and softness.

The paper web can before it is brought into the impulse dryer either can be only dewatered over suction boxes or besides slightly pressed according to a conventional process.

Simultaneously with the impulse drying the paper is given a three-dimensional structure. This can be made as shown in FIG. 1 by the fact that the heated rolls 13*a* and 13*b* are provided with an embossing pattern consisting of alternating raised and recessed areas. This structure is substantially maintained also in a later wetted condition of the paper, sine it has been imparted the wet paper web in connection with the drying thereof. Since the term embossing is normally used for a shaping performed on dried paper we have in the following used the term press moulding for the three-dimensional shaping of the paper that occurs simultaneously with the impulse drying. By this press moulding the bulk and absorption capacity of the paper is increased, which are important qualities for soft paper.

The paper can be pressed against a non-rigid surface, i.e. a compressible press felt 11. The rolls 14*a,b* can also have an elastically yielding surface, e.g. an envelope surface of rubber. The paper is herewith given a three-dimensional structure the total thickness of which is greater than the thickness of the unpressed paper. By this the paper is imparted a high bulk and by that a high absorption capacity and a high softness. Besides the paper will be elastic. At the same time a locally varying density is obtained in the paper.

The paper can also be pressed against a hard surface, e.g. a wire 11 and/or a roll 14*a,b* having a hard surface, at which the pattern of the heated roll 13*a,b* is pressed into the paper web under a heavy compression of the paper opposite the impressions, while the portions therebetween are kept uncompressed.

The patterns that are given the paper web in the two impulse drying steps are preferably different. One pattern may for example have a distinguishably greater dimension as compared to the second pattern. The different patterns may also have a determined but different periodicity, at which the difference in periodicity between the two patterns is considerably smaller than the periodicity of any of the patterns, at which a Moirae effect is obtained in the paper.

According to a further embodiment, the first pattern has such a structure that it forms continuous zones in the paper in a certain direction, while the second pattern forms continuous zones in another direction of the paper. If these zones are compacted areas in the paper that is obtained a strength improvement in the paper in both pattern directions.

According to the embodiment shown in FIG. 2 the three-dimensional pattern in the paper web is produced by a pattern band or belt 11', which extends around and is heated by the cylinder 13*a*. The pattern of the band 11' is press moulded into the paper web as this passes through the press nip 12*a* between the rolls 13*a* and 14*a*. The paper web 10 is supported by a felt 17 through the press nip.

Alternatively the wire 11, which during drying supports the paper web 10, could have a pattern, which during the impulse drying is press moulded into the paper web. The roll 13*a* can either be smooth, as is shown in FIG. 2, or have an embossing pattern. In the case the roll 13*a* is smooth the press moulded paper will have one smooth surface and one surface with indentations. In the case the roll 13*a* has an embossing pattern this will also be pressed into the paper, which thus on one side will have a pattern corresponding to the structure of the wire 11 and on the opposite side having a pattern corresponding to the embossing pattern of the roll. The pattern may but need not coincide and/or be the same or different.

According to the embodiment of FIG. 3 the two impulse drying cylinders 13*a* and *b* may have a common holder-on cylinder 14. The patterns from the two cylinders 13*a,b* will then be pressed into the paper web 10 from the same direction, said paper web being supported by a felt or wire 11 through the two press nips 12*a* and *b*.

According to one embodiment of the invention the paper web has a varying material composition as seen in its thickness direction, in such a way that it at least in the layer(s) that will be located closest to heated rolls 13*a,b* in connection with the impulse drying contains a certain amount of a material which softens, melts or hardens in the temperature interval 100–400° C. By this the paper will get a surface layer which contributes in reinforcing the structural stability of the paper also in wet condition. The pulp composition in the rest of the paper layers can on the other hand be chosen for optimizing other properties such as softness, strength, bulk and draping qualities.

Said material which in connection with impulse drying softens, melts or hardens can consist of a wet strength agent, synthetic or natural polymers with thermoplastic properties, chemically modified lignin and/or synthetic or natural polymers in the presence of softening agents or of a lignin-containing high yield pulp.

The wet strength agent, which hardens at high temperatures, can consist of a polyamide amine epichorhydrine resin, polyacryl amide resin, acrylic emulsion, urea-formaldehyde resin, polythene imine resin, a modified starch and/or a modified cellulose derivative. The content of wet strength agent in the layer which is intended to be located closest to the heated roll 13 should be at least 0.05 weight % calculated on the dry fiber weight.

Examples of materials that softens or melts in the temperature interval 100–400° C. are synthetic or natural polymers with thermoplastic properties, chemically modified lignin and/or synthetic or natural polymers in the presence of softening agents. The material can either be in the form of powder, flakes, fibers or an aqueous suspension, e.g. a latex dispersion. Examples of thermoplastic polymers are polyolefines such as polyethylene and polypropylene, polyesters etc.

By adding to the paper web said material, which is brought to soften or melt, there is achieved an increased amount of bonding sites in the paper web. By this the basis weight variation and three-dimensional structure, that has been imparted to the paper web in connection with the combined impulse drying and press moulding, is effectively permanented. This three-dimensional structure is maintained also in the wet condition of the paper.

According to the invention drying, thermobonding and pattern embossing takes place in one and the same step—the impulse drying step—at which there is achieved a more stable paper structure with a low degree of inner stresses, which otherwise will easily occur if the paper is dried and the fibrous structure by this is locked before the thermobonding.

As mentioned above the softening or melting material according to the invention may also consist of a lignin containing high yield pulp, which will be described more in detail below.

Paper can be produced by a number of different pulp types. If one disregards recovery pulp, which today is used to a great extent mainly for toilet paper and kitchen rolls, the most commonly used pulp type for soft paper is chemical pulp. The lignin content in such pulp is practically zero and the fibers, which mainly consist of pure cellulose, are relatively thin and flexible. Chemical pulp is a low yield pulp since it gives a yield of only about 50% calculated on the wooden raw material used. It is therefore a relatively expensive pulp.

It is therefore common to use cheaper so called high yield pulps, e.g. mechanical, thermomechanical pulp, chemomechanical pulp (CMP) or chemothermomechanical pulp (CTMP) in soft paper as well as in other types of paper, e.g. newsprint paper, cardboard etc. In high yield pulps the fibers are coarser and contain a high amount of lignin, resins and hemicellulose. The lignin and the resins gives the fibers more hydrophobic properties and a reduced ability to form hydrogen bonds. The addition of a certain amount of chemothermomechanical pulp in soft paper has due to the reduced fiber-fiber bonding a positive effect on properties like bulk and absorption capacity.

A special variant of chemothermomechanical pulp (CTMP) is so called high temperature chemothermomechanical pulp (HT-CTMP), the production of which differs from the production of CTMP of conventional type mainly by using a higher temperature for impregnation, preheating and refining, preferably no lower than 140° C. For a more detailed description of the production method for HT-CTMP reference is made to WO 95/34711. Characterizing for HT-CTMP is that it is a long fibrous—, easily dewatered— and bulky high yield pulp with a low shives content and low fines content.

It has according to the invention been found that high yield pulp is especially suitable for impulse drying since it is pressure insensitive, easily dewatered and has an open structure which admits the generated steam to pass through. This minimizes the risk for the paper to be overheated and destroyed during the impulse drying, which is performed at considerably higher temperatures than in other drying methods. The pressure insensitivity and the open structure depends on that the fibers in high yield pulp are relatively coarse and stiff as compared to the fibers in chemical pulp.

Impulse drying takes place at a considerably higher temperature than e.g. Yankee drying or through-air-drying, at which according to a theory, to which however the invention is not bound, the softening temperature of the lignin present in the high yield pulp is reached during the simultaneous impulse drying and press moulding. When the paper becomes cooler the lignin stiffens again and contributes in permanenting the three-dimensional structure that has been given the paper. This is therefore essentially maintained also in the wet condition of the paper, which strongly improves the bulk and absorption qualities of the paper.

According to one embodiment of the invention the paper contains, at least in the layer(s) which is/are located closest to the heated rolls 13*a,b* during the impulse drying, a certain amount of a high yield pulp, said amount should be at least 10 weight % calculated on the dry fiber weight, preferably at least 30 weight % and more preferably at least 50 weight %. Other layers may contain any optional pulp or combination of different types of pulp in order to give desired qualities such as softness, strength, bulk etc. So does for example chemical pulp, preferably long-fibrous kraft pulp, provide a high strength of the paper. Recycled pulp may of course also be contained in the paper.

The paper web is in this case formed in at least two separate layers, either by means of a multilayer headbox or by two or more consecutive headboxes, at which the pulp composition in at least two layers are different.

It is of course also possible to combine different types of the above stated materials such as lignin-containing high yield pulp and wet strength agent and melting of softening materials respectively, in order to further reinforce the stabilizing effect of the pattern structure of the paper.

The paper web may also be formed in at least three separate layers, at which the two outer layers each contains a certain amount of said material that softens, melts or hardens in the temperature interval 100–400° C., such as a lignin-containing high yield pulp, a wet strength agent, synthetic or natural polymers with thermoplastic properties, chemically modified lignin and/or synthetic or natural polymers in the presence of softening agents.

The invention is however not bound to the use of a special type of pulp, but may be applied with optional type of pulp or combinations of pulps.

Common additives such as wet strength agents, softening agents, fillers etc. may of course also be used in the paper. The paper web can after impulse drying undergo different types of per se known treatments such as addition of different chemicals, further embossing, lamination etc. It is also possible when transferring the paper web between two different wires, e.g. from a dewatering wire to a drying wire, to have a speed difference between the wires so that the paper web is slowed down in connection with the transfer. The paper web will then be compacted to a certain extent, which further increases the softness qualities.

What is claimed is:

1. Method of producing a paper having a three dimensional pattern of alternating raised and recessed portions by impulse drying, comprising the steps of:

passing a wet paper web through at least one press nip having a heated rotatable roll;

imparting a three dimensional pattern of alternating raised and recessed portions during passage through the press nip by at least one of a patterned wire, band or belt and a pattern on the heated roll;

pressing said pattern into the wet paper web against a counter means; and passing the wet paper web through at least a second press nip having a rotatable heated roll, the paper web during passage through said second press nip in connection with impulse drying is given a three dimensional pattern of alternating raised and recessed portions.

2. Method as claimed in claim 1, wherein the wet paper web has a moisture content of at least 10% by weight, before entering said second press nip.

3. Method as claimed in claim 2, wherein the wet paper web is moistened before entering the second press nip.

4. Method as claimed in claim 2, wherein the wet paper web has a moisture content of at least 20%, by weight, before entering the second press nip.

5. Method as claimed in claim 1, wherein the second press nip is inverted with respect to the first press nip, at which one side of the paper web is heated to the highest temperature in the first press nip while the other side is heated to the highest temperature in the second press nip.

6. Method as claimed in claim 1, wherein the three dimensional patterns given to the paper web in the first and second press nips are different.

7. Method as claimed in claim 1, characterized in that the counter means is provided with a non-rigid surface so that the paper web is given a three dimensional structure having a total thickness greater than the thickness of the unpressed paper web.

8. Method as claimed in claim 7, wherein the wet paper web is supported by a compressible press felt through the press nip, said press felt being said non-rigid counter means.

9. Method as claimed in claim 8, characterized in that the press felt is pressed against a resilient surface in the press nip.

10. Method as claimed in claim 1, wherein the paper contains at least 10% by weight, calculated on the dry fiber weight, of a lignin containing high yield pulp.

11. Method as claimed in claim 10, wherein the paper contains at least 30% by weight, calculated on the dry fiber weight of a lignin containing high yield pulp.

12. Method as claimed in claim 11, wherein the paper contains at least 50% by weight, calculated on the dry fiber weight of a lignin containing high yield pulp.

13. Method as claimed in claim 1, further comprising the step of adding to the paper web an amount of a material that does one of softens, melts and hardens in the temperature interval 100–400° C. to contribute in stabilizing the patterned structure that has been given the wet paper web.

14. Method as claimed in claim 13, wherein said material comprises at least one of synthetic or natural polymers with thermoplastic properties, chemically modified lignin and synthetic or natural polymers together with softeners.

15. Method as claimed in claim 14, characterized in that said material comprises a wet strength agent.

16. Method as claimed in claim 1, wherein the paper web has a varying material composition as seen in a thickness direction, and at least in the layer intended to be located closest to the heated roll contains an amount of a material that does one of softens, melts and hardens in the temperature interval 100–400° C. to contribute in stabilizing the patterned structure that has been given the paper.

17. Method as claimed in claim 16, wherein the material is at least one of a lignin containing high yield pulp, a wet strength agent, synthetic or natural polymers with thermoplastic properties, a chemically modified lignin and synthetic or natural polymers together with softeners.

18. Method as claimed in claim 1, used for producing absorbent soft paper.

* * * * *